United States Patent [19]

Becker, Jr.

[11] 4,172,769

[45] Oct. 30, 1979

[54] COKE OVEN DOOR SEAL AND JAMB

[75] Inventor: Joseph Becker, Jr., Pittsburgh, Pa.

[73] Assignee: Koppers Company, Inc., Pittsburgh, Pa.

[21] Appl. No.: 946,403

[22] Filed: Sep. 27, 1978

[51] Int. Cl.[2] ..... C10B 25/06; C10B 25/16

[52] U.S. Cl. ..... 202/248; 202/269

[58] Field of Search ..... 202/242, 248, 269; 49/316–321; 110/173 R

[56] References Cited

U.S. PATENT DOCUMENTS

| | | | |
|---|---|---|---|
| 2,038,051 | 4/1936 | Lymn | 202/248 |
| 2,744,858 | 5/1956 | Homan | 202/248 |
| 2,965,550 | 12/1960 | McClure | 202/248 |
| 3,149,615 | 9/1964 | Forsans | 110/173 R X |
| 3,172,825 | 3/1965 | Maloney | 202/248 |
| 4,016,046 | 4/1977 | Van Ackeren et al. | 202/269 X |

FOREIGN PATENT DOCUMENTS

| | | | |
|---|---|---|---|
| 49-35402 | 4/1974 | Japan | 202/248 |

*Primary Examiner*—Arnold Turk

*Attorney, Agent, or Firm*—R. Lawrence Sahr

[57] ABSTRACT

A coke oven door seal and corresponding door jamb are disclosed which provide apparatus coaction which is self-aligning and self-cleaning. The seal is pressurized, with a relatively inert atmosphere, above the range of pressures incurred within the coke oven, thus preventing escape of pollutants. A plurality of pressure maintaining devices maintain sealed contact between the door seal and the door jamb.

7 Claims, 4 Drawing Figures

COKE OVEN DOOR SEAL AND JAMB

BACKGROUND OF THE INVENTION

1. Field of the Invention

The invention relates generally to horizontal coke oven batteries and more specifically to doors and door jambs used to seal the chambers of horizontal coke oven batteries.

2. Description of the Prior Art

One of the critical current problems in the production of coke from coal is the presence of pollution and contaminants escaping from coke oven batteries. Horizontal coke oven batteries are each comprised of a series of long narrow horizontal coking chambers. At each end of each chamber is a door, one being on the pusher side of the oven and one being on the coke side of the oven. When a charge of coal has been coked, both the pusher side door and the coke side door are removed by mechanical door machines. Then a pusher machine commences to push the coke from the pusher side through the coking chamber and out the coke side into a collecting device.

Once a coking chamber has been pushed and is empty, apparatus associated with the door machines is brought into operation to clean the seals on the door and the corresponding door jambs. Typically, the cleaning is done by scraping both the seals and the jambs to remove deposits of coal tar and other material which has built up thereon during the coking of the coal. If the buildup on the seals and jambs is not removed, the seals are substantially prevented from performing their function, that is, to prevent the escape of pollutants. But it is the escape of these pollutants which causes the problem in the first place. The pollutants carry with them, in their escape, coal tar and other material which builds up on the seals and jambs. This fact suggests that the state of the art is deficient in providing effective sealing apparatus. If the available sealing apparatus were efficient, no buildup would occur and thus there would be no need for cleaning and, consequently, no cleaning apparatus associated with the door machines.

Through the years many novel devices and systems have been suggested to cure the problem. Recently, the problem has been deemed urgent. Concern over pollution has become prominent in view of increasing governmental regulations agitated by proponents of counter-economic advancement. A proliferation of prior art has been published recently in the field. Yet the coke industry continues to admit that pollution escape from coke oven doors is the largest single uncured factor in pollution control problems in coke plants.

The current state of the art in the design of door-sealing means is directed at the use of knife-edged seals projected against flat-machined surfaces. Flexible springs are utilized to apply pressure to the seals when the door is in place. Double knife-edged seals are known wherein two parallel knife edges are applied to the flat-machined surface. The concept here seems to be, if one will not work, try two. It has even been suggested, in relation to the double knife-edged seals, that the space separating the two edges could be pressurized beyond the interior pressure of the coke oven. However, in practice, this suggestion has proved unworkable. The heat differential between the interior of the oven and the exterior causes some slight degree of warpage of the knife edge. The pressure differential rapidly disappears as this warpage occurs. Once the pressure equalizes the chamber between the two knife edges equalizes with the interior of the coke oven, the pollution commences to be expelled around the doors.

Forethinkers have viewed this problem and postulated that if you cannot pressurize the chamber between the double knife edges, perhaps it is possible to draw a vacuum on it, thus allowing the pollution to be sucked up and introduced back into the coke oven before it can escape to pollute. Preliminary tests have indicated that this approach is viable as a means of eliminating the pollution. However, the buildup on the seals on door jambs still remains as a problem, thus necessitating the seal and jamb cleaning apparatus associated with the door machines.

SUMMARY OF THE INVENTION

The present invention provides a "Y" shaped seal disposed continuously completely around the inner edge of a coke oven door, the fork of the "Y" facing inwardly toward the door jamb. Also provided is a door jamb having a triangular-shaped sealing face, the apex of the triangle facing outwardly toward the fork of the "Y" of the seal. The included angle of the fork of the "Y" is less than the included angle of the apex of the triangular sealing face. The "Y" shaped seal is composed of a resilient material allowing the forks of the "Y" to be biased laterally, or spread apart, with applied pressure, yet "spring" back to shape when the pressure is removed.

In operation, the coke oven door is positioned to be closed, the seal generally being positioned in alignment with the triangular sealing face. The door is then moved inwardly, forcing the fork of the "Y" of the seal over the apex of the triangular sealing face, spreading the forks of the "Y" apart into a biased position. The scraping action of this movement serves to clean any residual buildup that might occur on the mating surfaces of the seal and the sealing face. The resilient nature of the seal causes spring pressure of that seal against the sealing surface at two points, i.e., on both inner surfaces of the fork of the "Y" where it meets the two sides of the face adjacent to the triangular apex. Additional means for maintaining the contact of the seal against the sealing face are mounted to the door and coact with the seal.

Means is provided for applying a positive pressure to the chamber formed between the seal and the sealing face. The pressure applied is greater than the pressure range that prevails within the coking chamber during the coking operation. Thus, the pollutants created are contained in the coking chamber, being prevented from seeking a lower pressure zone for expansion.

That fork of the "Y" exposed to the greatest heat emanating from the coking chamber does tend to warp. The direction of the warp specifically is a tendency to curl away from the heat. This tendency forces this fork more firmly against the corresponding mating surface of the sealing face, thus increasing the efficiency of the seal.

These features, as well as other features of the present invention, will be more completely disclosed and described in the following specification, the accompanying drawings and the appended claims.

DETAILED DESCRIPTION

Figure 1:
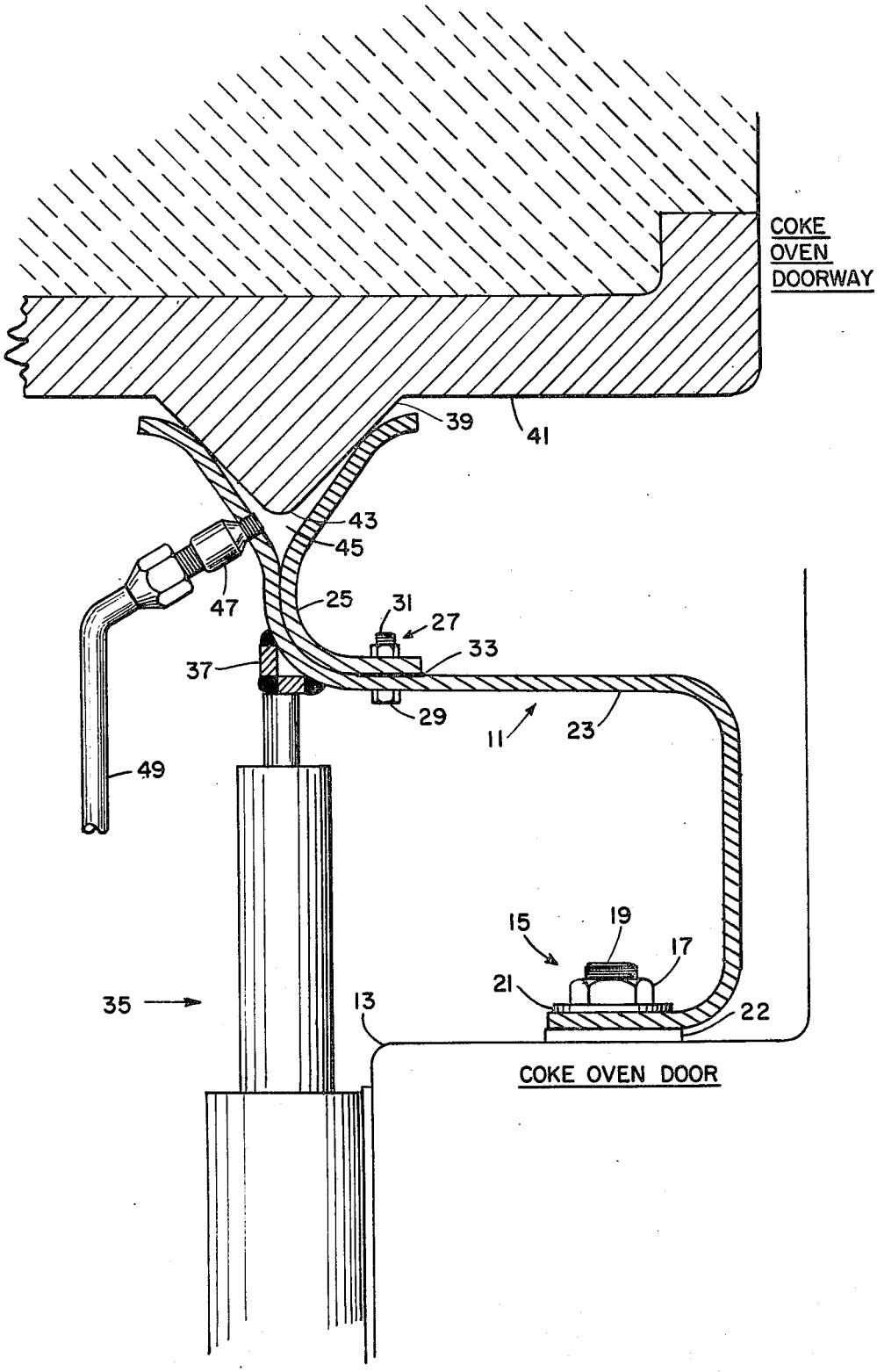
FIG. 1 is a cross-sectional view of a portion of a coke oven door in the closed position with seal mated with the sealing surface.
Figure 3:
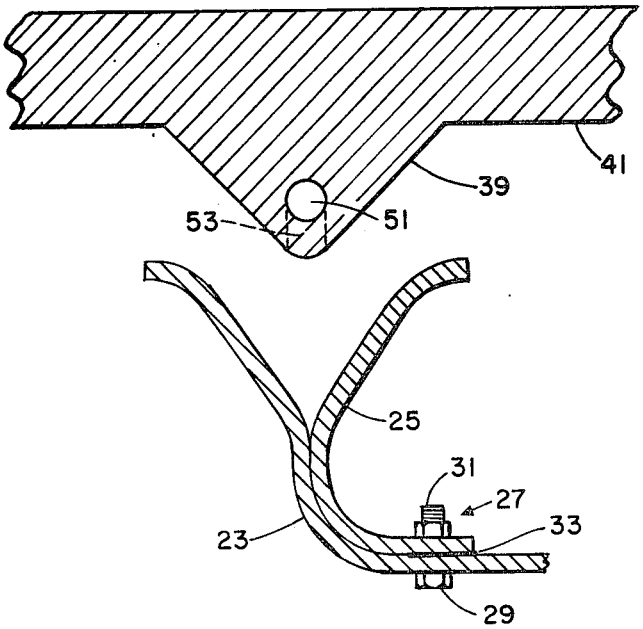
FIG. 3 is a cross-sectional view, similar to FIG. 1, but with the seal withdrawn from the sealing surface and including alternate means of introducing inert gas into the seal.
Figure 4:
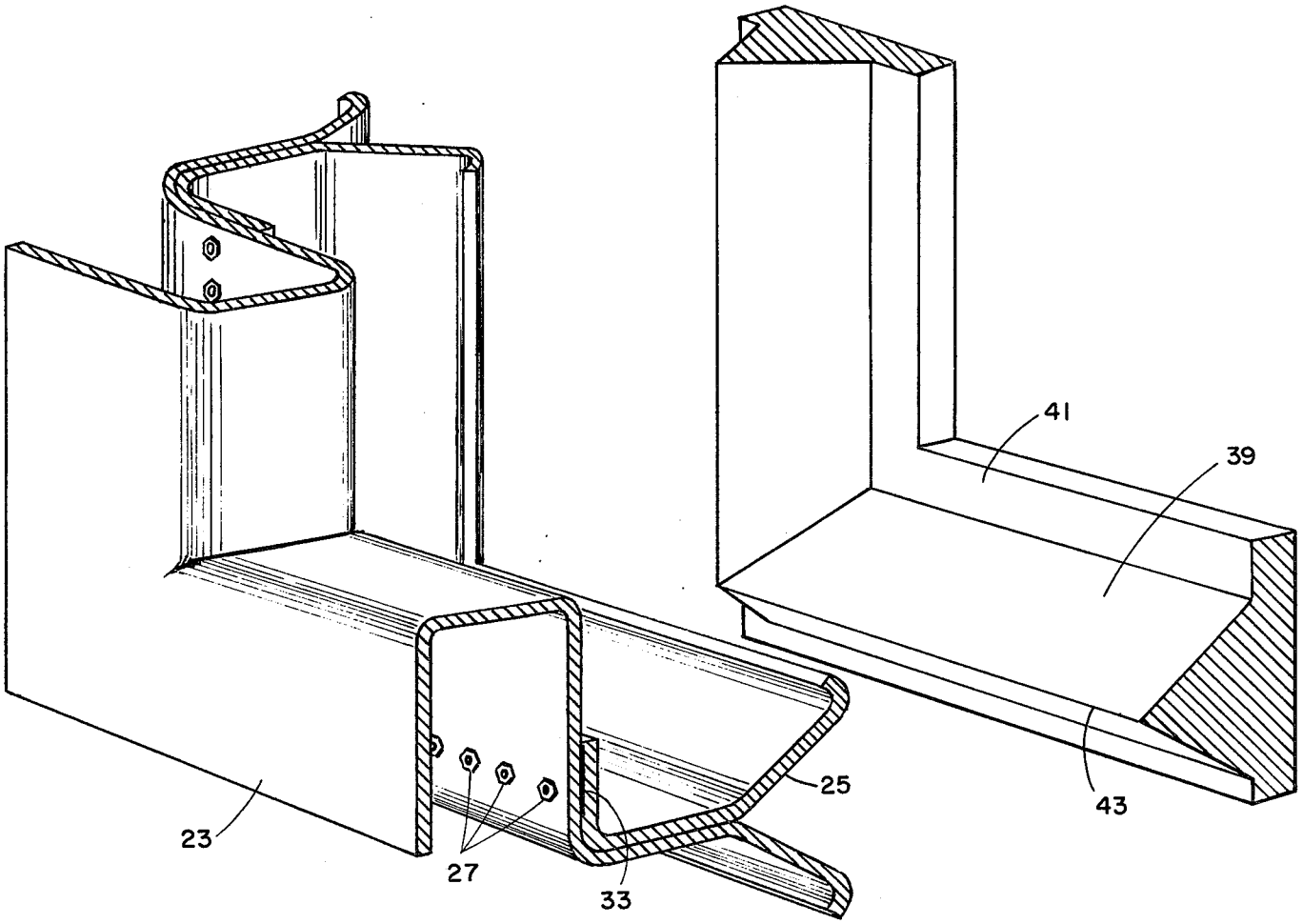
FIG. 4 is an orthographic projection of a corner of the seal in a position drawn away from the corner of the sealing surface.

Referring to FIG. 1, there is shown a seal, generally designated by the numeral 11, mounted adjacent the peripheral edge 13 of a coke oven door. The mounting is accomplished by mounting means 15, preferably fasteners, for example, a plurality of nuts 17, bolts 19 and washers 21, arranged as shown in FIG. 1. A continuous gasket 22 separates the seal 11 from the edge 13 and creates a seal therebetween. The seal 11 is composed of a flexor member 23 and an inner leg 25. The inner leg 25 is mounted to the flexor member 23 about as shown in FIGS. 1, 3 and 4 by means preferably of a plurality of fastening devices 27 composed of screws 29 and corresponding nuts 31. A compression gasket 33 is interposed between the inner leg 25 and the flexor member 23 surrounding the area of operability of the fastening devices 27. The compression gasket 33 is continuous and contiguous with the extension of the seal 11, continuing, unbroken, around the peripheral edge 13 of the coke oven door, serving to maintain pressure differentials in relation to the seal 11 as will be explained hereinafter. A series of spring plungers 35 are arranged in spaced-apart relationship surrounding the peripheral edge 13 of the coke oven door in a manner well known to those skilled in the art. Each spring plunger 35 is fixed to the coke oven door and is operative on the seal 11 by way of communication with a corresponding seat 37. Each of the seats 37, one for each spring plunger 35, is fixed to the exterior side of the flexor member 23, for example, by welding, about as shown in FIG. 1.

The seal 11, composed of the flexor member 23 and the inner leg 25, cross-sectionally, takes the form of a "Y" as illustrated in FIGS. 1, 3 and 4. The fork of the "Y" is positioned generally to correspond to a continuous triangular sealing face 39 which surrounds the coke oven doorway. The triangular sealing face 39, preferably, forms an integral part of the door jamb 41. The apex 43 of the triangular sealing face 39 is directed toward the converging forks of the "Y" of the seal 11. The triangular sealing face 39 preferably takes the general form of an isosceles triangle, the two legs adjacent to the apex 43 being equal in length. The included angle of the apex 43 is greater than the included angle between the two legs of the "Y" of the seal 11, as shown in FIG. 3.

The material of construction of the seal 11 is required to have a resilient, spring-like property. Preferably, the material is a straight chrome based stainless steel. As the seal 11 is forced against the triangular sealing face, the legs of the "Y", i.e., the flexor member 23 and the inner leg 25, are forced to tend to conform to the included angle of the apex 43. That is, the legs of the "Y" are spread apart and surround the triangular sealing face 39 when the coke oven door is placed in the closed position, as shown in FIG. 1. The legs of the "Y", being resilient, form a tight seal with the triangular sealing face 39.

The door jamb 41, as well as its integral triangular sealing face 39, are preferably machined from cast ductile iron, a material which is generally considered to have a low relative degree of susceptibility to heat warpage. The preferred material of the seal, on the other hand, is considerably more susceptible to heat warpage, a complementary feature in the operation of the seal. When the coke oven door has been placed in the closed position as shown in FIG. 1, heat from the oven chamber dissipates outwardly from the direction of the coke oven doorway to the inner surface leg 25. This causes that inner surface of the inner leg 25 to be heated up to a greater degree than the outer surface of the inner leg 25 (the surface of the inner leg 25 in direct contact with a leg of the triangular sealing face 39). This heat, or temperature, differential causes the inner surface to expand at a rate and to a degree greater than the expansion of the outer surface of the inner leg 25. This phenomena causes the inner leg 25 to tend to curl toward the adjacent leg of the triangular sealing face and, thus, tends to produce a greater sealing effect between the outer surface of the inner leg 25 and that leg of the triangular sealing face 39 with which it is in contact.

In the preferred embodiment, the legs of the "Y" of the seal 11 are curled outwardly about as shown in FIGS. 1, 2, 3 and 4. The outwardly curled formation of the legs of the "Y" produces a wider mouth to the "Y". This enhances the ability of the seal 11 to be self-aligning in relation to apex 43 of the triangular sealing surface 39. As will be noted from reference to FIG. 3, the interior intersection of the fork of the "Y" of the seal may be laterally misaligned with the apex 43 of the triangular sealing face 39, yet so long as that apex 43 is aligned with any point within the interior fork of the "Y" of the seal 11, movement of the coke oven door toward the door jamb 41 will produce a contact of the apex 43 with the interior fork of the "Y" of the seal 11, and, thus, laterally tend to force the seal 11 and the coke oven door into correct alignment, as shown in FIGS. 1 and 3.

The outwarly curled formation of the legs of the "Y", in particular of the inner leg 25, also further enhances the sealing ability of the seal 11. As the heat from the oven chamber causes the inner leg 25 to tend to curl toward the triangular sealing face 39, as peviously explained, what happens is that the opposite surface of the as-formed curl of the inner leg 25 tends to uncurl, bring a greater surface area of contact between the inner leg 25 and the adjacent leg of the triangular sealing surface 39, thus a greater sealing surface area.

In the closing operation, the coke oven door is moved toward the coke oven doorway. At a point prior to full closure, the seal 11 first makes contact with the triangular sealing face 39. At about this point the legs of the "Y" of the seal commence to be forced apart, spreading further as the coke oven door is moved closer to the coke oven doorway. This movement causes the legs of the "Y" to scrape the legs of the triangular sealing face 39 which are adjacent the apex 43. This scraping action tends to dislodge any residue built up on the triangular sealing face 39 by circulation of gases within the coke oven. Thus the seal 11 self-cleans the triangular sealing face 39.

Means for introducing and maintaining an elevated gas pressure within the chamber 45 formed by the seal 11 against the triangular sealing face 39 is utilized. Preferably a hose fitting 47 is fixed through the flexor member 23 at a point adjacent the chamber 45 so formed, as shown in FIG. 1. A hose 49, or other flexible means of introducing gas, is connected to the hose fitting 47. A gas, at a pressure above the maximum pressure normally encountered within a coke oven, is introduced through the hose 49 and hose fitting 47 into the chamber. Preferably, this gas is relatively inert, for example, nitrogen, to curtail long range corrosion. When the coke oven door is in the closed position, as shown in FIG. 1, the chamber 45 is formed and the pressurized gas is introduced. If a separation of the seal 11 from the triangular sealing surface 39 occurs due to heat warpage, the gas within the chamber escapes. This escape of gas prevents the gases within the coke oven chamber from entering the chamber 45 or escaping to the atmosphere. If the gases from the coke oven chamber cannot get into the chamber, the possibility of accumulation of residue, caused with those gases, on the contact surfaces of the seal 11 and the triangular sealing face 39 is eliminated. This feature, coupled with the self-cleaning feature, provides a means for eliminating the conventional seal and jamb cleaning apparatus found on conventional coke oven machinery.

An alternate means for introducing pressurized gas into the chamber 45 is illustrated in FIG. 3. A port 51 extends longitudinally into the triangular sealing face 39. One or more cross-ports 53 connect the port 51 to the chamber 45 at about the apex 43 of the triangular sealing face 39. The port 51 is connected, also, to means (not shown) for conveying the pressurized gas thereto, for example, a pipeline running to the door jamb 41.

Figure 2:
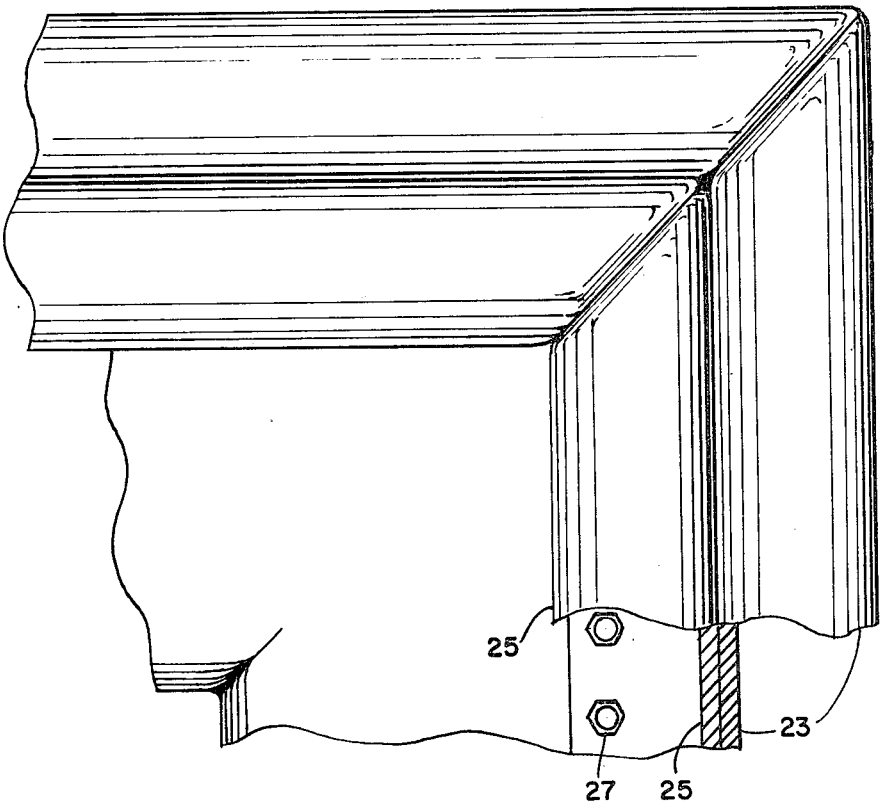
FIG. 2 is a view of a corner of the seal as viewed from the door jamb.

FIGS. 2 and 4 depict a corner of the seal 11 and a corner of the seal 11 relative to a corner of the triangular sealing face 39, respectively. Alternately, radiused corner sections could be used rather than distinct angles, but it is believed that fabrication costs would be increased.

According to the provisions of the patent statutes, what is considered to represent the best embodiment of the present invention, its preferred construction and its best mode of operation have been illustrated and described. However, it is to be understood that, within the scope of the appended claims, the invention may be practiced otherwise than as specifically illustrated and described.

What is claimed is:

1. In combination with a horizontal coke oven, a pressurized coke oven door seal and door jamb apparatus which is self-aligning and seal-cleaning, comprising:

(a) a resilient "Y" shaped seal disposed continuously around the inner edge of a coke oven door, the legs of said fork of the "Y" being biasable laterally to increase and decrease, respectively, the included angle between said legs at the instance of force being imposed upon and removed from the inner surfaces of said legs adjacent said included angle;

(b) a door jamb including a triangular sealing surface, disposed continuously around the outer face of said door jamb, the fork of the "Y" shaped seal being diverted inwardly toward the door jamb and the apex of said triangular sealing surface being directed outwardly toward said "Y" shaped seal, said triangular sealing surface generally corresponding in position, shape and dimension to said "Y" shaped seal when said coke oven door is pressed against said door jamb in a closed position, the included angle of said apex of said triangular sealing surface being less than the included angle of said fork of the "Y" when said force is removed from said inner surfaces of said legs; and (c) means for imposing and maintaining a positive pressure within the cavity formed between said "Y" shaped seal and said triangular sealing surface when said coke oven door is pressed against said door jamb in a closed position.

2. The invention described in claim 1 further comprising spring means, associated with said "Y" shaped seal, which impose opposite pressure upon said "Y" shaped seal, operable to force said "Y" shaped seal against and over said triangular sealing surface when said coke door is pressed against said door jamb.

3. The invention described in claim 1 wherein said "Y" shaped seal comprises:

(a) a flexor member fixed to said coke oven door;

(b) an inner leg fixed to said flexor member; and (c) means for sealing the point of fixture of said inner leg to said flexor member such that said positive pressure within said cavity is prevented from escaping at said point of fixture.

4. The invention described in claim 1 wherein said legs of said "Y" shaped seal are curved outwardly away from said included angle of said fork of said "Y" shaped seal.

5. The invention described in claim 1 wherein said means for imposing and maintaining a positive pressure within said cavity is cabable of imposing and maintaining a pressure within the cavity above the maximum pressure incurred within the coke oven with which said coke oven door and door jamb are associated.

6. The invention described in claim 1 wherein said "Y" shaped seal is composed of a straight chrome stainless steel.

7. The invention described in claim 1 wherein said door jamb is composed of cast ductile iron.

* * * * *